US010046534B2

(12) United States Patent
Faucher et al.

(10) Patent No.: US 10,046,534 B2
(45) Date of Patent: Aug. 14, 2018

(54) COMPACTION RECEPTACLE

(71) Applicant: Compaction Technologies, Inc., Mendota Heights, MN (US)

(72) Inventors: James Faucher, Saint Michael, MN (US); Luke Lundquist, Maple Grove, MN (US); John Vangen, Blaine, MN (US)

(73) Assignee: Compaction Technologies, Inc., Brooklyn Park, MN (US)

( * ) Notice: Subject to any disclaimer, the term of this patent is extended or adjusted under 35 U.S.C. 154(b) by 851 days.

(21) Appl. No.: 14/600,729

(22) Filed: Jan. 20, 2015

(65) Prior Publication Data

US 2016/0207272 A1 Jul. 21, 2016

(51) Int. Cl.
*B30B 9/30* (2006.01)
*B65F 1/14* (2006.01)

(52) U.S. Cl.
CPC ..... *B30B 9/3042* (2013.01); *B30B 9/3007* (2013.01); *B30B 9/3046* (2013.01); *B30B 9/3085* (2013.01); *B65F 1/1405* (2013.01); *B65F 1/1431* (2013.01); *B30B 9/306* (2013.01)

(58) Field of Classification Search
CPC ... B30B 9/3042; B30B 9/3085; B30B 9/3046; B65F 1/1431; B65F 1/1405
See application file for complete search history.

(56) References Cited

U.S. PATENT DOCUMENTS 3,447,447 A 6/1969 Rutty
3,817,170 A 6/1974 Mayer
3,960,071 A 6/1976 Mayer et al.
3,979,008 A * 9/1976 Weeks ..... B30B 1/006 100/229 A
4,018,148 A * 4/1977 Wolbrink ..... B30B 9/3032 100/229 A
4,024,806 A 5/1977 Weeks et al.
4,041,856 A * 8/1977 Fox ..... B30B 9/30 100/214
4,064,798 A * 12/1977 Wolbrink ..... B30B 9/3032 100/218
4,080,889 A * 3/1978 Shiloni ..... B30B 9/3032 100/219
4,096,421 A * 6/1978 Farber ..... B30B 9/3007 318/258
4,100,850 A * 7/1978 Wolbrink ..... B30B 1/006 100/229 A
4,188,872 A 2/1980 Chrablow
4,213,387 A 7/1980 McCaney et al.
4,369,700 A 1/1983 Flagg
4,444,099 A * 4/1984 Paleschuck ..... B30B 9/3032 100/127
4,548,132 A 10/1985 Moon
(Continued)

*Primary Examiner* — Sean Michalski
(74) *Attorney, Agent, or Firm* — Winthrop & Weinstine, P.A.

(57) ABSTRACT

A compaction capable receptacle may include a housing with a trash receiving opening, a compaction unit arranged within the housing, and a trash bin arranged within the housing and articulable between a compaction position within the housing and a trash receiving position within the housing, the compaction position aligning the trash bin with a compaction stroke of the compaction unit and the trash receiving position aligning a portion of the trash bin with the trash receiving opening.

20 Claims, 16 Drawing Sheets

(56) References Cited

U.S. PATENT DOCUMENTS 4,565,125 A * 1/1986 Khan ..... B30B 15/041 100/214
4,715,498 A * 12/1987 Hanifl ..... B65F 1/08 206/366
4,914,340 A * 4/1990 Fox ..... B30B 9/3032 100/229 A
5,007,814 A 4/1991 Saunders et al.
5,137,212 A * 8/1992 Fiterman ..... B65F 1/10 109/46
5,645,172 A * 7/1997 Shantzis ..... B07B 13/00 209/703
5,690,025 A * 11/1997 Hawkins ..... B30B 1/34 100/229 A
5,695,114 A * 12/1997 Evans ..... B65F 1/004 220/909
6,012,370 A 1/2000 Kobayashi
6,367,377 B1 4/2002 Gawley et al.
6,481,467 B2 11/2002 Czebatul et al.
6,578,762 B1 * 6/2003 Knappmiller ..... B65F 1/10 235/380
7,007,598 B1 * 3/2006 Patras ..... B30B 9/3007 100/215
7,950,325 B2 5/2011 Kachkovsky et al.
8,683,920 B1 * 4/2014 Oropeza ..... B30B 9/3042 100/215
2004/0250711 A1 * 12/2004 Ernst ..... B65F 1/02 100/245
2005/0005785 A1 * 1/2005 Poss ..... B30B 9/3003 100/240
2006/0156933 A1 7/2006 Hofele et al.
2007/0289967 A1 * 12/2007 Pierce ..... B65F 1/004 220/212
2009/0145309 A1 * 6/2009 Fox ..... B30B 9/3007 100/35
2011/0041711 A1 * 2/2011 Nickell-Lean ..... B30B 1/006 100/214
2011/0056393 A1 3/2011 Kachkovsky
2011/0174170 A1 * 7/2011 Fritz ..... B30B 9/3007 100/35
2011/0192293 A1 * 8/2011 Hitchcock ..... B30B 1/10 100/229 A
2013/0220150 A1 * 8/2013 Preen ..... A47B 77/18 100/245
2014/0025589 A1 * 1/2014 Yang ..... B65F 1/1426 705/308
2014/0041538 A1 * 2/2014 Parmar ..... B65F 1/1405 100/152
2015/0101499 A1 * 4/2015 Hitchcock ..... B30B 1/103 100/229 A
2015/0246497 A1 * 9/2015 Papadopoulos ..... B30B 9/3017 100/246
2016/0130082 A1 * 5/2016 Gwon ..... B09B 3/00 100/48
2017/0197783 A1 * 7/2017 Lundquist ..... B65F 1/1405
2017/0215980 A1 * 8/2017 Debusk ..... A61B 50/36
2017/0362027 A1 * 12/2017 Traber ..... B30B 1/04

* cited by examiner

COMPACTION RECEPTACLE

FIELD OF THE INVENTION

The present disclosure relates to a compactor for compacting and temporarily storing debris. More particularly, the present disclosure relates to a compactor that is functional as a waste receptacle in a public setting. Still more particularly, the present disclosure relates to a publicly safe waste receptacle/compactor wherein the compaction head is arranged substantially against a top of a compaction bin thereby providing for a relatively small design suitable for relatively small spaces.

BACKGROUND

The background description provided herein is for the purpose of generally presenting the context of the disclosure. Work of the presently named inventors, to the extent it is described in this background section, as well as aspects of the description that might not otherwise qualify as prior art at the time of filing, are neither expressly nor impliedly admitted as prior art against the present disclosure.

Trash compactors are often used to minimize the volume of space that trash occupies. In some cases, trash compactors double as a waste receptacle and a compactor. In these cases, the compaction functionality of the receptacle may reduce the number of times that the receptacle needs to be emptied of trash.

In recent years, trash compactors have begun to be placed in public settings such that the volume of waste from public waste receptacles may be reduced in addition to reducing the number of times that such receptacles may need to be emptied. For example, in some cases, compaction-capable trash receptacles may be placed at various locations in amusement parks or public parks.

Given the public setting of these devices, at least two issues that have been addressed are safety and damage protection. That is, given the mechanical moving parts and the power of those parts for compaction, controls have been implemented to assure that users are prevented from reaching into or otherwise placing body parts in the path of the compaction head when the machine is compacting. Still further, user manipulation of the machines has also been reduced to avoid users damaging the machine through rough use. For example, in contrast to kitchen trash compactors of the past that included a trash bin that was part of an openable and closeable drawer, the public compactors are more akin to a public waste receptacle with a door across the receptacle opening and little to no other external moving or manipulable parts.

Open spaces such as amusement parks and public parks are adapted for large trash receptacles and, as such, compaction-capable trash receptacles that are safe and resistant to damage and have been developed for these locations tend to be bulky and large. This large size may be a result of needing to accommodate the compaction apparatus, the safety controls, and the damage resistance and because the open space did not create a need for a smaller device.

One location that tends to create a large volume of trash is public restrooms. Moreover, the trash created tends to be relatively light and not very dense. As such, this type of trash is highly compactable. However, restrooms tend to be relatively small spaces that are not amenable to large trash receptacles. In some cases, the receptacles are built into the walls to save space. As such, use of compaction-capable receptacles that have been implemented in public spaces may not be a viable option.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

In some embodiments, a compaction capable receptacle may include a housing with a trash receiving opening. The receptacle may also include a compaction unit arranged within the housing and a trash bin arranged within the housing. The receptacle may be articulable between a compaction position within the housing and a trash receiving position within the housing. In the compaction position, the bin may be aligned with a compaction stroke of the compaction unit. In the trash receiving position, a portion of the bin may be aligned with the trash receiving opening.

While various embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure, in some embodiments, relates to a compaction-capable trash receptacle that is relatively small in size and adapted for use in restrooms or other relatively small spaces. The receptacle may include a compaction head that is arranged substantially against a top portion of a trash/compaction bin and the trash/compaction bin is adaptable to articulate within the receptacle enclosure between a trash receiving position and a compaction position. In some embodiments, for example, the bin may be positioned substantially below the compaction head and may tip out from under the compaction head to receive trash and tip back below the compaction head for the compaction process. The top portion of the bin may be beveled or chamfered to provide a substantially horizontally arranged opening for receiving trash into a tipped bin. When the bin is arranged below the compaction head, while the top portion may be sloped, the sides of the bin may be substantially parallel to the direction of motion of the compaction head. In this manner, a relatively small compaction unit may be provided because the head room normally provided above the bin and below the compaction head for receiving trash may be eliminated. At the same time, an opening and closing drawer may be avoided.

Figure 1:
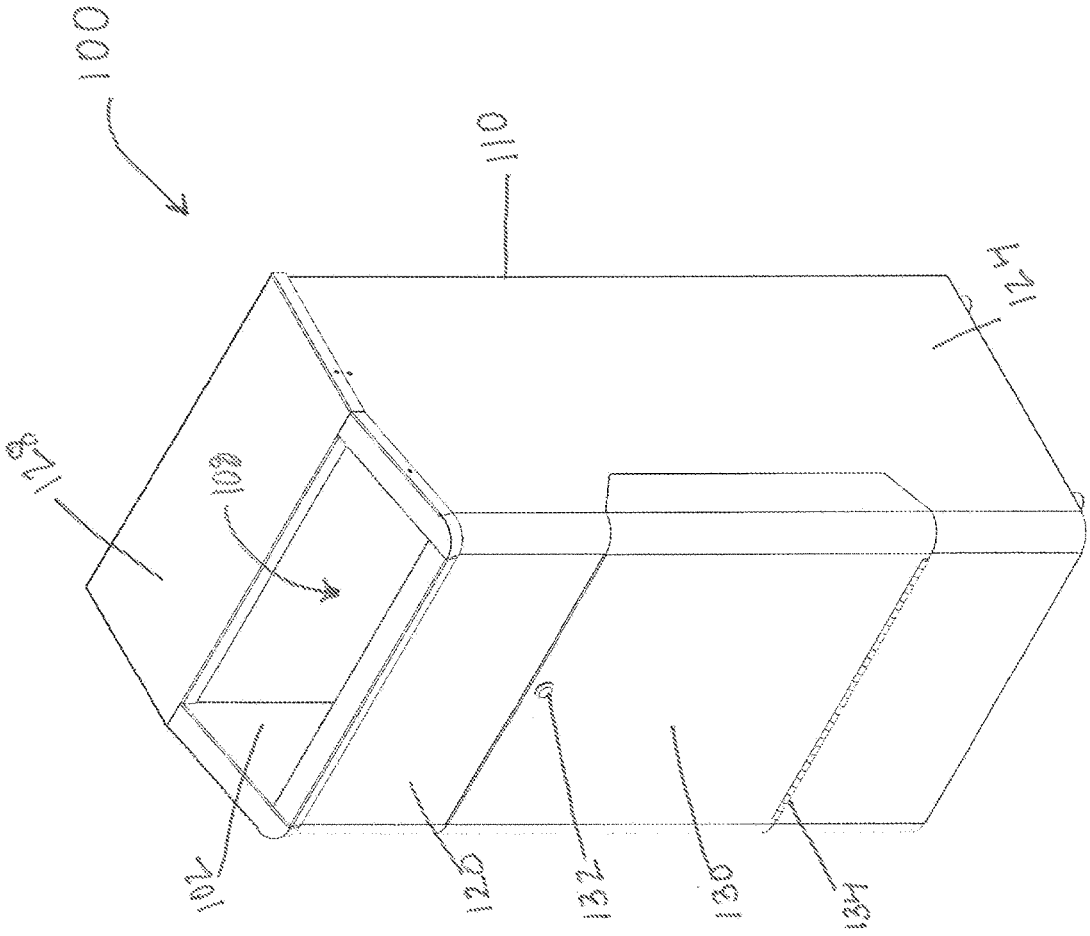
FIG. 1 is a perspective view of a compaction receptacle according to one or more embodiments.
Figure 2A:
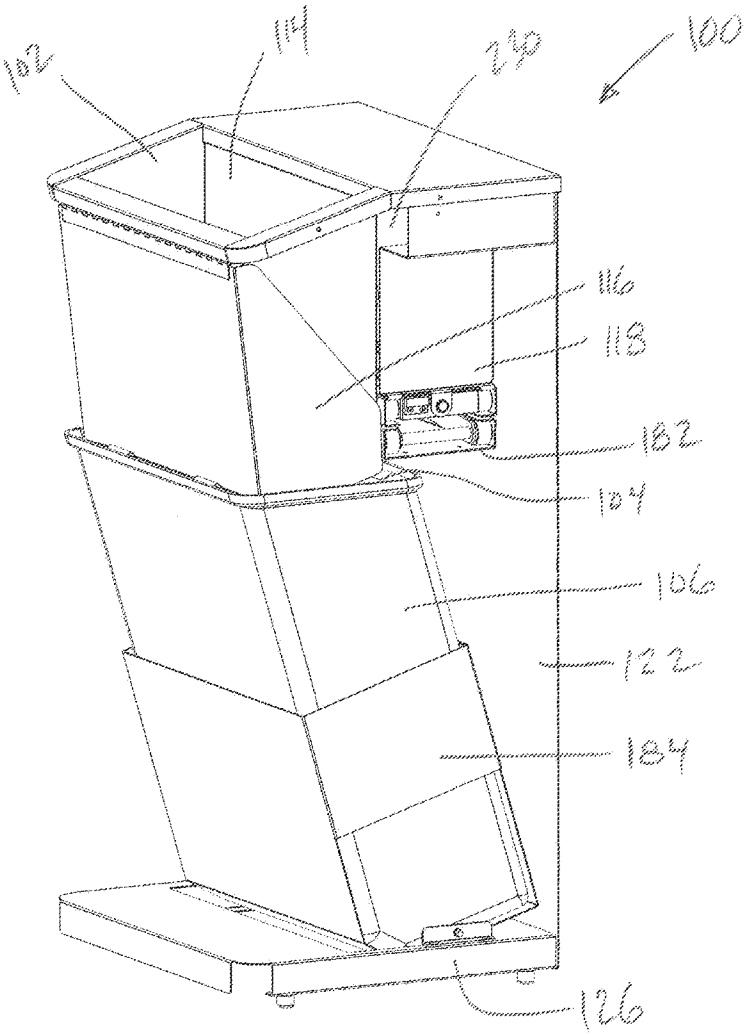
FIG. 2A is a perspective view of the compaction receptacle of FIG. 1 with a portion of the housing removed and the trash bin in a trash receiving position, according to one or more embodiments.
Figure 2B:
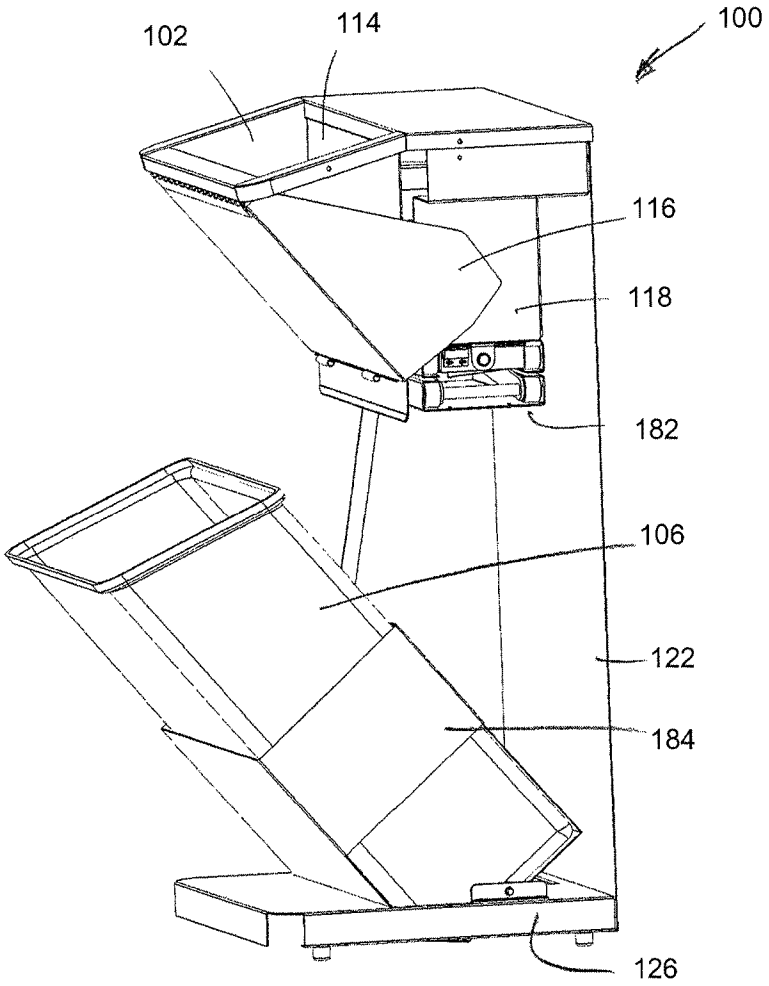
FIG. 2B is a perspective view of the compaction receptacle of FIG. 1 with a portion of the housing removed and the trash bin in a removal position, according to one or more embodiments.
Figure 2C:
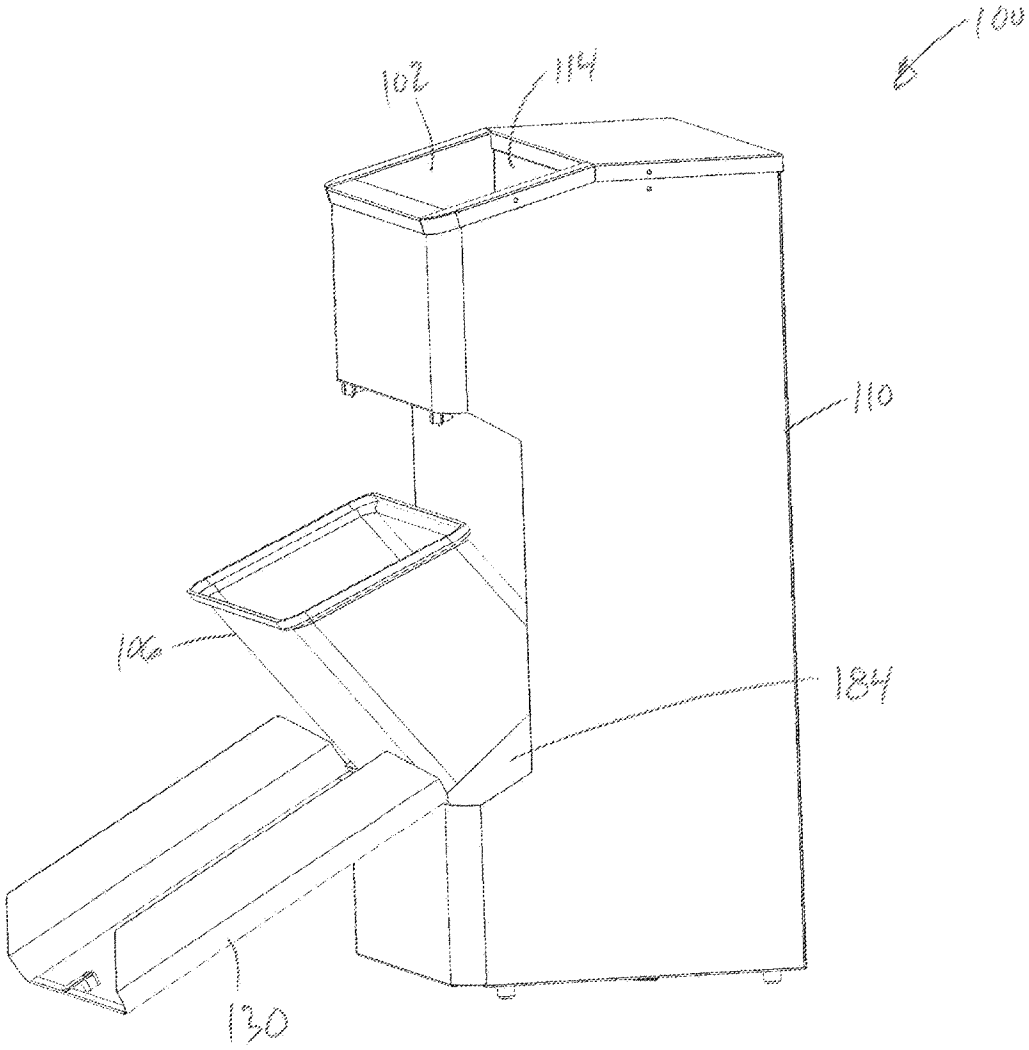
FIG. 2C is a perspective view of the compaction receptacle of FIG. 1 with the housing being opened and showing the trash bin in a removal position, according to one or more embodiments.
Figure 3:
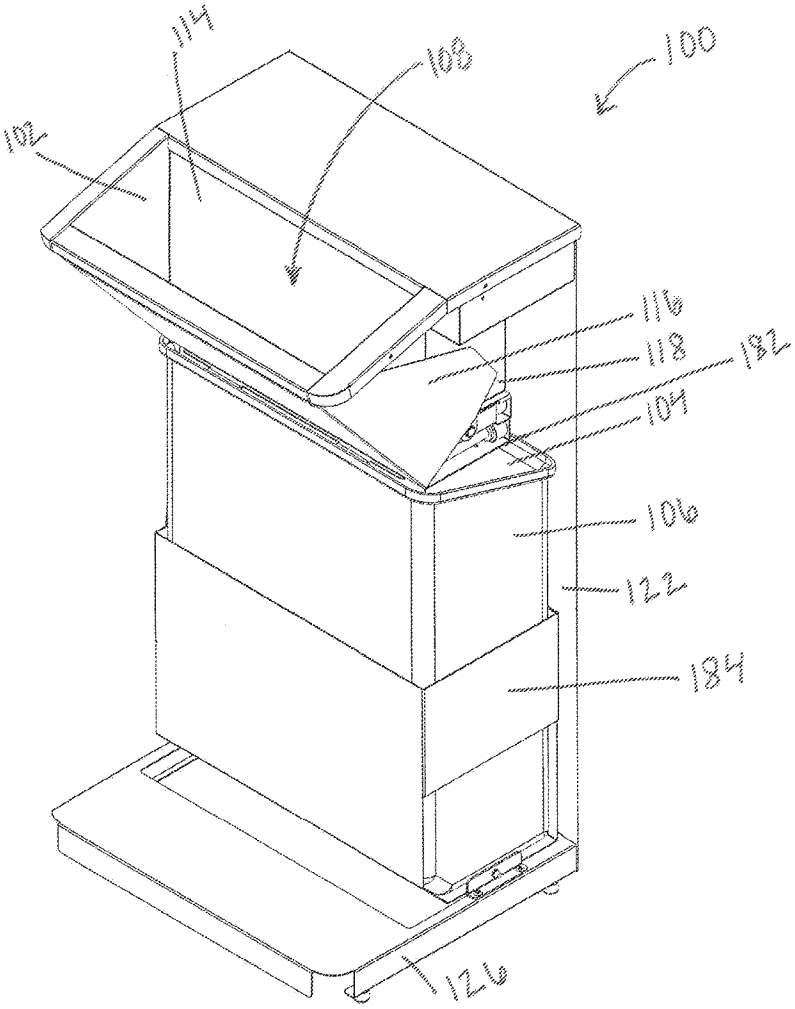
FIG. 3 is a perspective view of the compaction receptacle of FIG. 1 with a portion of the housing removed and the trash bin in a compaction position, according to one or more embodiments.

Referring now to FIG. 1, a compaction-capable trash receptacle 100 is shown. As shown, the compaction-capable trash receptacle 100 may be configured for receiving trash into and through an opening 102 in a top portion of the receptacle 100. In a first condition, as shown in FIG. 2A, the trash may fall directly through the opening 102, through the mouth 104 of the trash bin 106 and into the trash bin 106. In a second condition, as shown in FIG. 3, when the bin 106 is in the compaction position, a holding area 108 may be formed such that the trash placed through the opening 102 in the top portion of the receptacle 100 may rest in a holding area 108 awaiting return of the trash bin 106 after compaction. When the trash bin 106 returns to its receiving position, the holding area 108 may automatically or naturally (i.e., by gravity) deliver the trash in the holding area 108 into the trash bin 106. As shown, the compaction-capable trash receptacle 100 may include a housing 110, a trash/compaction bin or tub 106, a bin or tub position control system 112 (see linkage-type in FIG. 11), backstop portion 114, a holding and/or closure mechanism 116, and a compaction unit 118. The receptacle may also include a microcomputer or controller for operating the trash position of the trash bin and operating the compaction unit. In addition to the two positions shown in FIGS. 2 and 3, yet a third position may be provided which positions the bin in suitable position for removal. FIG. 2B and 2C show this removal position and FIG. 2C shows this position together with the housing showing how the housing may be opened to allow for the removal position of the bin.

As shown in FIG. 1, the housing 110 may form an outer portion of the receptacle providing for smooth surfaces free of sharp edges that are generally safe for presence in public areas. In addition, the housing 110 may be configured for supporting several of the internal components of the receptacle and may be further configured for managing and/or withstanding the compressive and/or tensile forces imparted during the compaction process. As such, the receptacle may be substantially frameless or frame free. The housing 110 may include a front wall 120, a back wall 122, and two opposing side walls 124. The housing 110 may also include a base or bottom 126 and the housing 110 may include a top 128.

The top 128 of the housing 110 may include a trash receiving opening 102 arranged generally horizontally or slightly angled relative to an otherwise horizontal top portion 128. For example, as shown, the top portion 128 may have a generally horizontal portion and a slightly sloped portion and the trash receiving opening 102 may be arranged on the slightly sloped portion. The top portion 128 may be sized to extend over the top of the compaction unit 118 and provide a reasonably sized trash receiving opening 102. In the embodiment shown, the top portion 128 may be approximately twice the size of the footprint of the compaction unit 118 and may include a trash receiving opening 102 that is approximately equal in size to the footprint of the compaction unit 118 or half the size of the top portion 128.

The front wall 120 of the housing 110 may include an access panel 130. As shown the access panel 130 may include a hinged panel allowing for access to the inside of the housing 110 by pulling and pivoting the panel 130 into an open position. The panel 130 may include a drawer/door pull-type handle 132 allowing the panel 130 to be grasped and pulled open. In some embodiments, the hinge or pivot point 134 may be arranged on the bottom of the panel 130 as shown or, alternatively, the hinge or pivot point 134 may be arranged on one of the sides or the top of the panel 130. The access panel 130 may extend beyond the front wall 120 and around the front corners to the sidewalls 124 as shown. This may allow for a relatively large access opening when the panel 130 is opened and, as such, may provide for removal of the trash bin 106 for purposes of emptying the contents of the bin as show in FIGS. 2B and 2C. In other embodiments, additional or alternative access panels may be provided on the sidewalls 124, back wall 122, or bottom 126 of the housing 110, for example.

Figure 5:
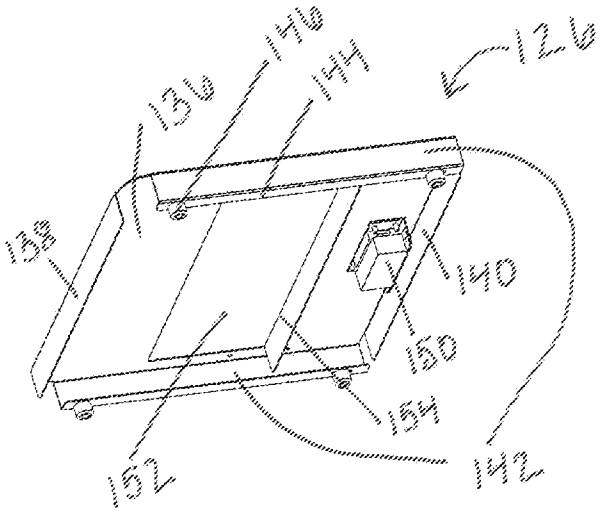
FIG. 5 is an underside perspective view of the base of FIG. 4, according to one or more embodiments.
Figure 4:
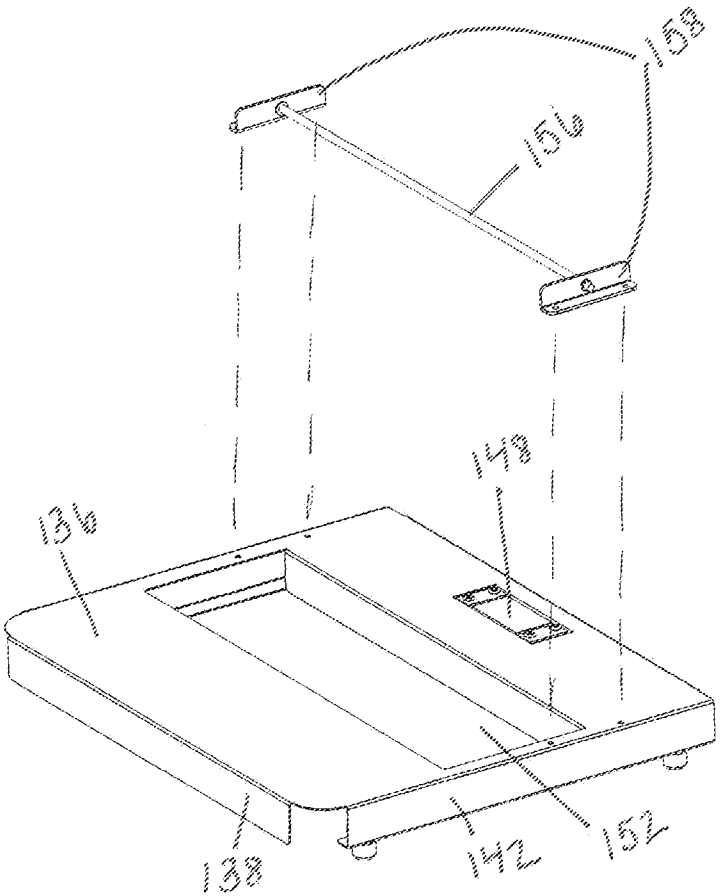
FIG. 4 is a perspective view of the base of the compaction receptacle of FIG. 1, according to one or more embodiments.

The base 126 of the housing 110 shown in FIGS. 4-5 may be configured to support the receptacle 100 relative to a surface and, in particular, may be configured for supporting and securing the trash bin 106 during compaction and accommodating the trash bin 106 when it is pivoted to a trash receiving position. As shown, the base 126 may include a generally flat plate portion 136 having a series of return flanges directed toward a supporting surface. A front 138 and back 140 flange may be provided and two side flanges 142 may be provided. The side flanges 142 may extend generally perpendicular to the flat plate portion 136 to a far edge and may include a return portion 144 extending beneath the flat plate portion 136. Feet or other support elements 146 may be arranged on the return portion 144 as shown to elevate the base 126 above a support surface such as a floor or ledge, for example.

For purposes of securing the trash bin 106 during compaction, an opening 148 and a locking mechanism 150 may be arranged near the rear portion of the flat plate portion 136 of the base. The opening 148 may allow for an under mounted or flush mounted locking mechanism 150 to be secured to an underside of the flat plate portion 136. As shown, the locking mechanism 150 may include a magnetic lock, for example, that may be selectively activated and deactivated to secure the trash bin 106. In addition, the flat plate portion 136 may include a clearance area 152 in the form of an opening arranged generally in a central portion of the flat plate portion 136. The clearance area opening 152 may be generally rectangular having front, back, and side edges. The clearance area opening 152 may have a width measured side-to-side across the base that is slightly larger than a side-to-side dimension of the trash bin 106 such that the a portion of the trash bin 106 may tip into and through the opening 152 when the trash bin 106 is in a trash receiving position. The rear edge of the opening 152 may define the plane or be in close proximity to the plane in which the pivot axis for the trash bin 106 is positioned. The rear edge of the clearance opening 152 may include a stiffening rib 154 extending downward from the flat plate portion 136 and extending along the length of the back edge.

The base 126 may also include a pivot shaft 156 supported by a pair of brackets 158. The brackets 158 may be arranged along the side edges of the base 126 and may include angle brackets having one leg secured to the base 126 and an upstanding leg. The upstanding legs may include an opening that may be aligned with the rear edge of the clearance opening 152 and a bushing may be provided therein. A pivot shaft 156 may be positioned in the bushings or openings and may extend generally across and in alignment with the rear edge of the clearance opening 152 from one bracket to another. The pivot shaft 156 may be adapted for nesting in a groove in the bottom of a bin holster and/or trash bin 106 and defining a pivot axis for each of these elements. This is described more fully below.

Figure 7:
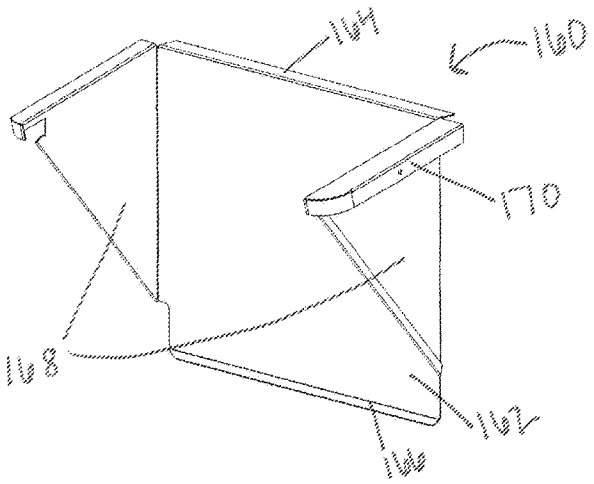
FIG. 7 is a perspective view of a backstop portion, according to one or more embodiments.
Figure 6:
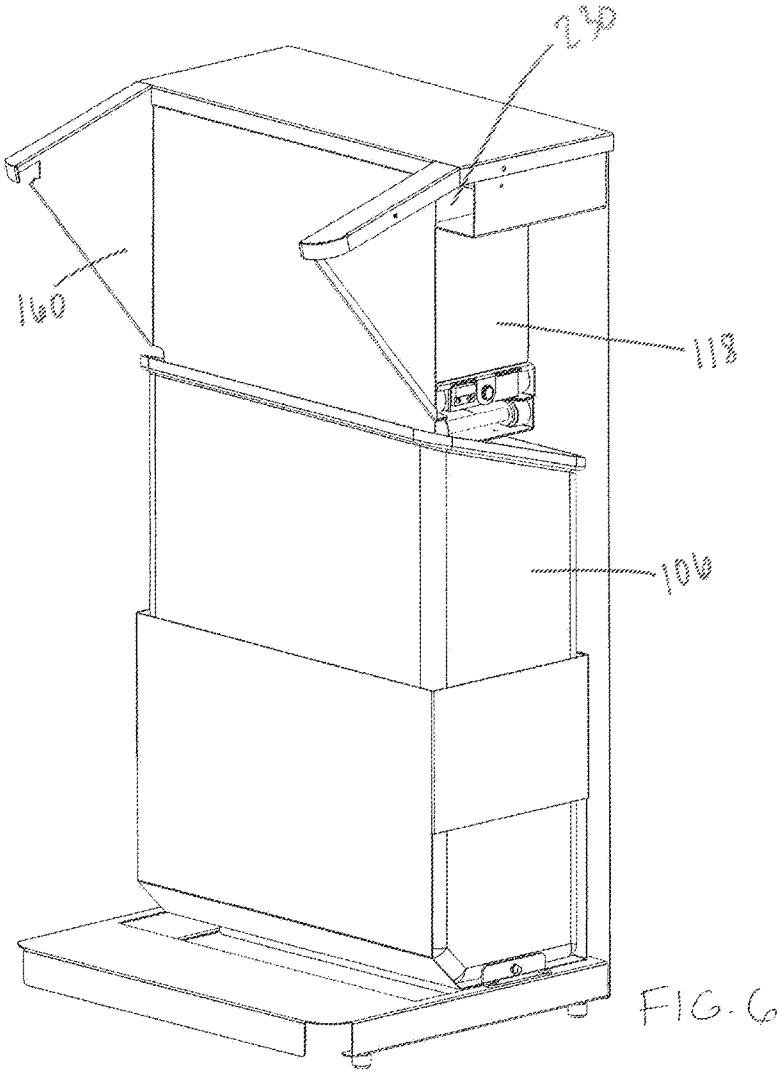
FIG. 6 is a perspective view of the compaction receptacle of FIG. 1 with the housing and holding mechanism removed, according to one or more embodiments.

As shown in FIGS. 6 and 7, the housing may also include a backstop portion 160 that extends downwardly along a backside of the trash receiving opening 102. The backstop portion 160 may be configured to close off the region behind the opening 102 where the compaction unit 118 may be arranged. The backstop portion 160 may further function to arrest horizontally moving debris or debris moving partially horizontally and partially vertically, such that the debris may fall into the trash bin 106 if the bin 106 is in a trash receiving position or such that the debris may fall into a holding area 108 when the trash bin is in a compaction position. The backstop portion 160 may include a substantially flat plate backing 162 with a top edge, a bottom edge and two side edges. The top edge may include an attachment flange 164 for supporting an underside of a compaction unit cover. The bottom edge may include a tongue or flap 166 arranged and positioned to extend into the trash bin or tub 106 when the bin or tub 106 is in a compaction position. As described more fully below and as shown in FIG. 6, the tongue or flap 166 may be arranged substantially adjacent and inside a front wall of the bin 106 when the bin 106 is in a compaction position. A pair of stiffening sides 168 may extend generally perpendicularly from the side edges of the flat plate backing 162 and may include a substantially triangular shape extending along the side edges and extending forwardly relative to the receptacle 100 to a point. The diagonal edge of the stiffening hanger may be folded over to stiffen the edge and/or provide for a smoother edge. The top edge of the stiffening sides 168 may include a hanger flange 170 configured for handing the backstop 160 off of the sidewalls 124 of the housing 110 of the receptacle 100.

Figure 9:
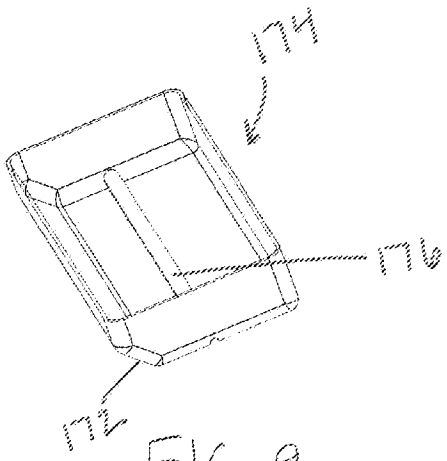
FIG. 9 is a perspective cross-sectional view of the trash bin of FIG. 8, according to one or more embodiments.
Figure 8:
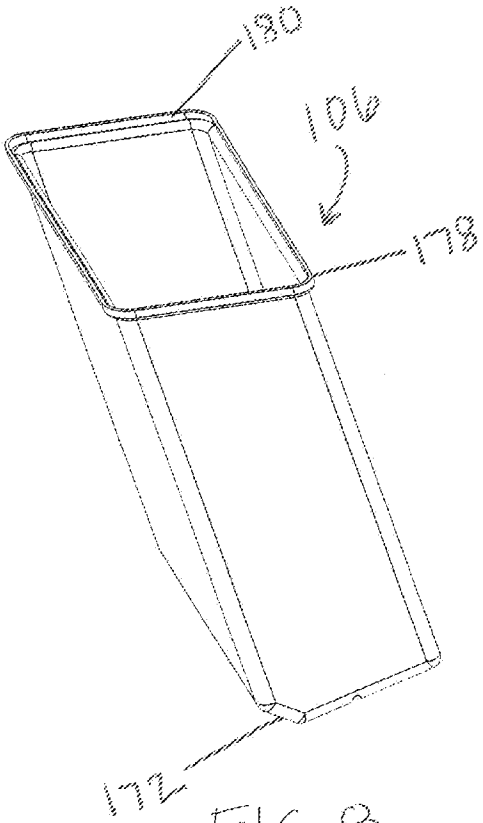
FIG. 8 is a perspective view of a trash bin, according to one or more embodiments.

The receptacle 100 may also include a trash bin or tub 106. The trash bin or tub 106 may be configured to receive and hold trash and to withstand forces imparted on the tub or bin from the compaction unit. Still further, the bin or tub 106 may be configured to articulate or move between several positions including a trash receiving position, a bin removal position, and a compaction position. As shown in FIGS. 8 and 9, the tub or bin 106 may include a front wall, back wall, and a pair of sidewalls that form a substantially rectangular shape with rounded corners when viewed from above. The size and shape of the tub or bin 106 may be coordinated with the size and shape of a compaction head such that the compaction head may travel through all or a portion of the length of the bin 106 substantially freely and without hanging up or catching on the sidewalls of the bin 106. In addition the rectangular shape of the bin 106, the tub or bin 106 may have and a chamfered front bottom edge 172 to avoid bottoming out when the tub is tipped into a trash receiving position or a bin removal position.

The tub or bin may have a substantially flat bottom 174 with a rib 176 extending along the length of the bottom from one sidewall to an opposing side wall. The rib 176 may provide for a running slot or groove in the bottom surface that may define a pivot axis for the tub or bin 106 and may provide for a pivot shaft 156 or other pivot mechanism to be arranged along and/or through the bottom of the tub 106. In addition, the rib 176 may function to reinforce the bottom 174 of the tub 106 to resist bending forces imparted thereon by the compaction unit 118.

The trash bin or tub 106 may include an upper rim 178 that may define a mouth of the bin and may include a flared upper edge 180 of the bin. The flared upper edge 180 may flare outward away from the central volume of the bin 106 and may then turn upward to form a sort of groove along the inside edge of the bin 106 and around the upper perimeter of the bin 106. While the flared upper edge 180 may function to stiffen the upper portion of the bin 106, the resulting groove may be particularly advantageous where the upper most edge of the bin 106 engages the closure mechanism 116 described below. In particular, when the bin 106 is in a compaction position, a lower edge of the closure mechanism 116 may nest in this groove and be pressed between or at least positioned between the upper edge of the bin 106 and the backstop portion 160 of the receptacle 100, thereby sealing the holding area 108 off from, and preventing debris appendages or other items from entering the bin 106 during compaction.

Figure 10:
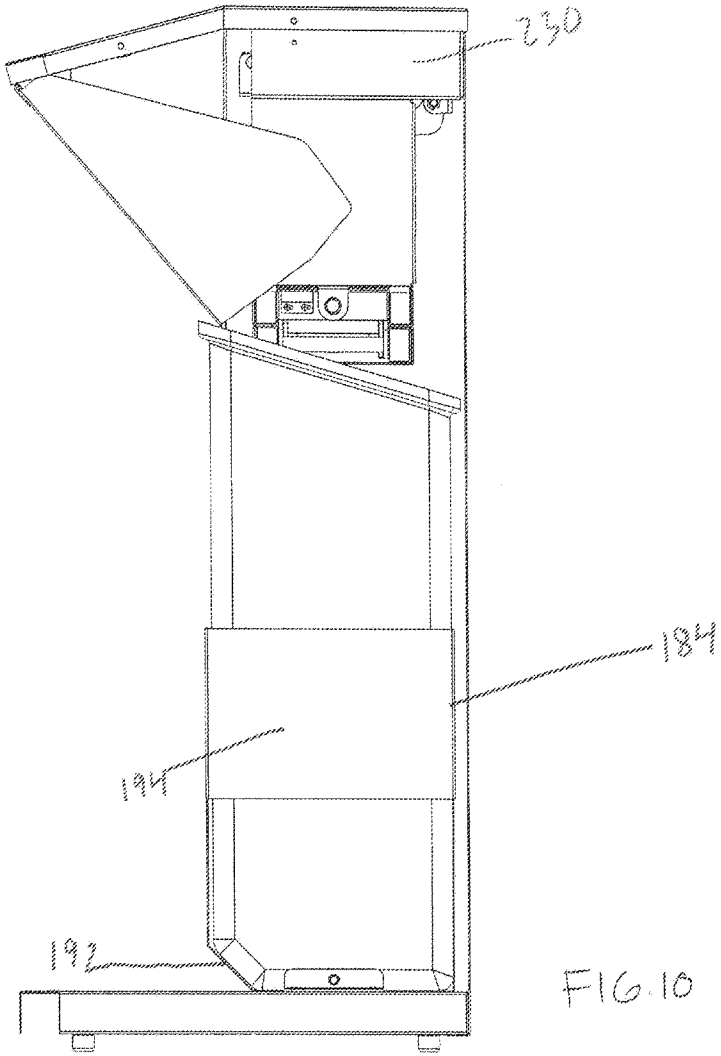
FIG. 10 is a cross-sectional view of the receptacle of FIG. 1, according to one or more embodiments.
Figure 11:
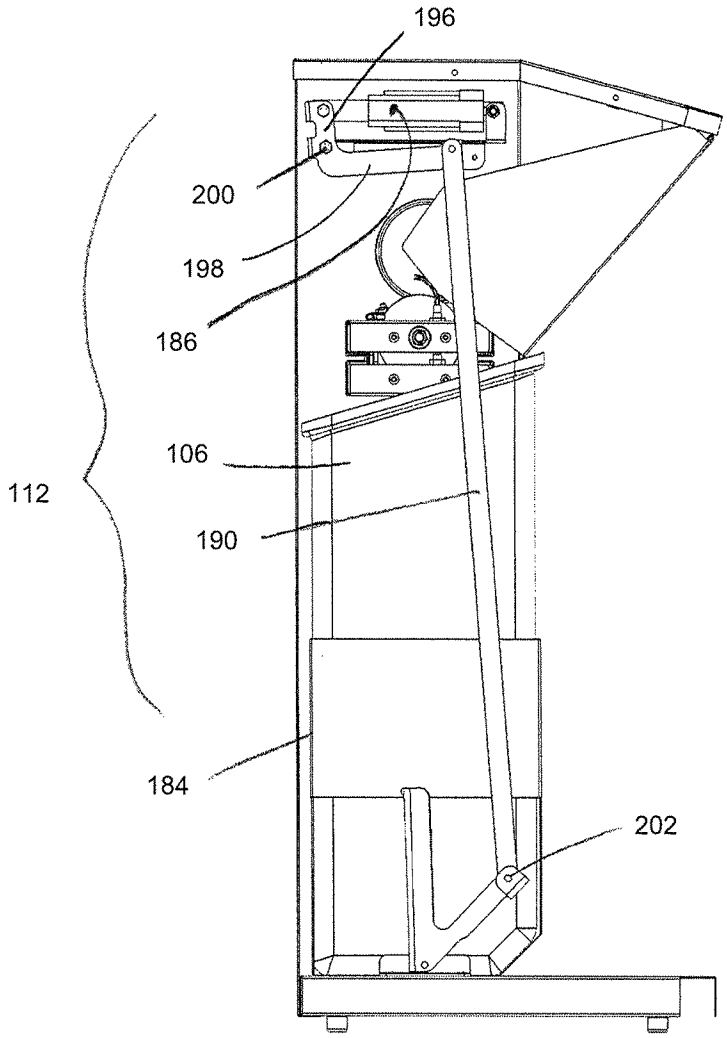
FIG. 11 is a cross-sectional view of the receptacle of FIG. 1, according to one or more embodiments.

In addition to being flared, the upper rim 178 may define a top plane that is sloped relative to the planes defined by the front and back wails of the bin. The sloped top plane of the bin 106 may allow for differing heights to be used for the front and back walls of the bin 106 to control and/or limit the motion of the bin 106. That is, the backstop portion 160, described below, of the receptacle may include a bottom tongue or flap 166 that extends into the bin 106 when the bin 106 is in a compaction position. That is, as shown in FIGS. 6, 10, and 11, when the bin 106 is in the compaction position, the inside surface of the front wall of the bin 106 may be substantially aligned with the front surface of the tongue or flap 166 of the backboard 160. A portion of the closure mechanism 116 may be sandwiched therebetween thereby arresting rearward pivoting motion of the bin 106. However, when the bin 106 tips forwardly, the rearwall may clear the bottom of the tongue or flap 166 due to its shorter height and, as such, the bin 106 may be tipped forwardly sufficient to be removed from the receptacle 100 for emptying the bin 106 without interference from the tongue or flap 166.

In some embodiments, the amount of slope relative to the plane or planes defined by the front and and/or back walls of the bin 106 may be equal to the angle that the bin 106 is designed to rest at in the trash receiving position. As such, when the bin 106 is in the trash receiving position, the upper rim 178 of the tub or bin 106 may be arranged substantially horizontally. In some embodiments, the slope of the upper rim 178 relative to the front and back walls of the bin 106 may range from approximately 5 degrees to approximately 45 degrees, or from approximately 15 degrees to approximately 30 degrees, or a slope of approximately 20 degrees may be provided. Still other slopes for the top rim 178 of the bin 106 within the ranges mentioned or outside the ranges mentioned may be provided.

As shown in FIG. 3, the tub or bin 106 may be arranged within the housing 110 in a back portion of the space defined by the housing 110. The base of the bin 106 may be arranged substantially directly below the compaction unit 118 and the bin 106 may be substantially aligned with a travel path of the compaction head 182 when the bin 106 is in a compaction position. The tub 106 may be tipped toward the front of the receptacle 100 for the trash receiving position or the bin removal position, but the bin 106 may be generally prevented from translating frontward or backward within the housing 110 unless and until the bin 106 is removed for emptying.

The position of the tub or bin 106 may be controlled by a bin position control system. The system may include a bin shroud or holster 184, an actuation mechanism 186, a linkage 188, and a strut or tie 190.

As shown in FIGS. 3, 6, 10, and 11, the bin shroud or holster 184 may be configured to nestably receive and support the trash bin or tub 106. For example, the holster 184 may include a front wall, a back wall, and a bottom that are substantially the same shape and size as those of the tub or bin 106, but may be slightly larger for receiving the bin therein. However, as shown, the front and back walls may stop short of extending the full height of the tub or bin 106. Like the tub or bin 106, the front bottom edge 192 of the holster 184 may be chamfered to avoid bottoming out when the holster 184 and bin 106 are pivoted to the trash receiving or bin removal position. Also like the tub or bin 106, the bottom of the holster 184 may include a rib extending along its length. The rib may be adapted to engage the groove in the bottom surface 174 of the trash bin 106 and to receive a pivot shaft 156 extending across the base 126 of the receptacle housing 110. The holster 184 may also include a pair of sidewall strap panels 194 extending from the front wall to the back wall along the sides of the holster 184. As such, the sidewall strap panels 194 may hold the front and back walls in position relative to one another and may provide side support to the tub or bin 106 to prevent the tub or bin 106 from sliding along the nested ribs of the tub/holster.

The holster 184 may be configured for support by the shaft 156 positioned in the base of the receptacle 110. The rib of the holster 184 may nestably receive the shaft 156 and may pivot about the shaft 156 together with the bin 106. Such pivoting motion may be controlled by the remaining portions of the position control system 112.

The holster 184 may also include a position locking mechanism such as a magnet for engaging a mag lock. Other position locking mechanisms may be provided such as a mechanical releasable latch, for example, or other types of lock mechanisms. In the embodiment shown, a magnet may be secured via screws, bolts, adhesive and/or brackets, to a bottom surface of the holster 184 on a rear portion thereof or the mag lock on the base may be configured to interlock with the metal holster. As such, when the holster 184 is tipped upright and the mag lock 150 on the base 126 of the housing 110 is activated, the holster 184 may be secured in an upright position thereby holding the bin 106 in an upright position.

The actuation mechanism 186 of the position control system may include a linear actuator, rotating motor, or other actuation mechanism, for example. Generally, the tub or bin 106 may be configured to tend toward the trash receiving position due to gravity. That is, the trash holding or closure mechanism 116 described below may naturally pull on the bin 106 via gravity causing the bin 106 to tend toward a tipped trash receiving position. The actuation mechanism 186 may, thus, be adapted to pull the bin 106 into a compaction position or limit the rate at which the bin 106 falls into an open position.

In the embodiment shown in FIG. 11, a linear actuator 186 may be pivotally engaged with a linkage. The linkage, as shown, may include an L-shaped arm having an actuator lever 196 and a tie lever 198. As shown, the actuator 186 may include an extended position causing the actuator lever 196 to be positioned in a substantially upright position and the tie lever 198 to be in a substantially horizontal position. When the actuator 186 moves to a retracted position, the actuator lever 196 may pivot about a linkage pin 200 causing the tie lever 198 to also rotate about the linkage pin 200 and moving downward and clockwise about the linkage pin 200. This may allow for play in a flexible tie or, in the case of a rigid strut, may push downward on the strut and, thus downward on the front edge of the holster 184, if tied directly thereto, or, alternatively on the front edge of the pivot bracket, as shown. That is, as shown, the tie or strut 190 may be secured via a pin 202 to a front portion of the holster 184 or it may be tied to a pivot bracket near the bottom of the holster and play in a flexible tie may allow the holster 184 to pivot under gravity about the base shaft. Controlled motion of the actuator 186 may, thus, allow for controlled tipping of the bin 106 by limiting the amount of play that is provided in the tie. In other embodiments, rather than a linear actuator and a linkage, a motor/pulley system with a cable or cord may be used to control the motion of the holster 184 and the bin 106 positioned therein. Other actuation mechanisms may include a motor or other rotational actuation device connected directly to the holster to cause rotation about the base shaft or together with the base shaft.

Figure 12:
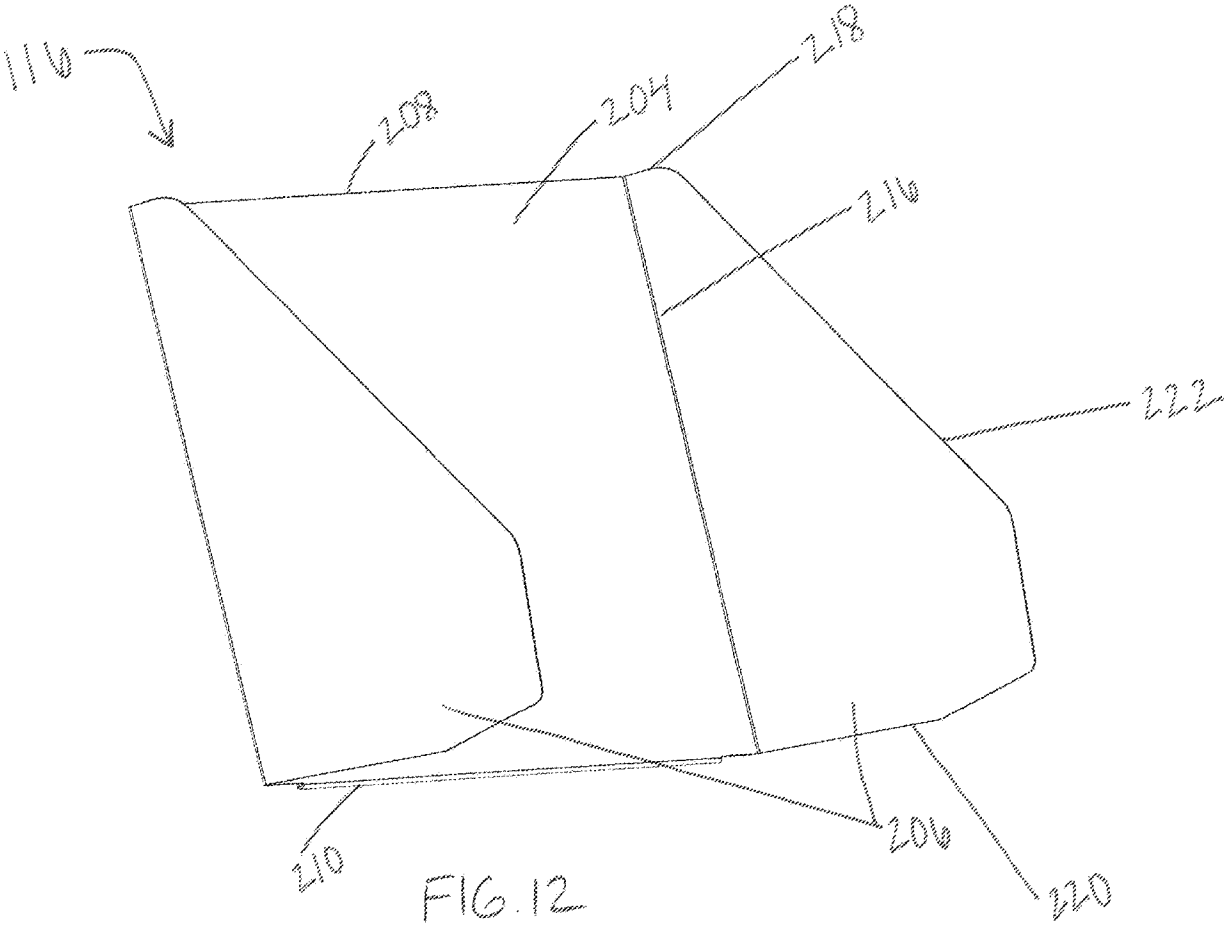
FIG. 12 is a perspective view of a holding mechanism of the receptacle of FIG. 1, according to one or more embodiments.
Figure 13B:
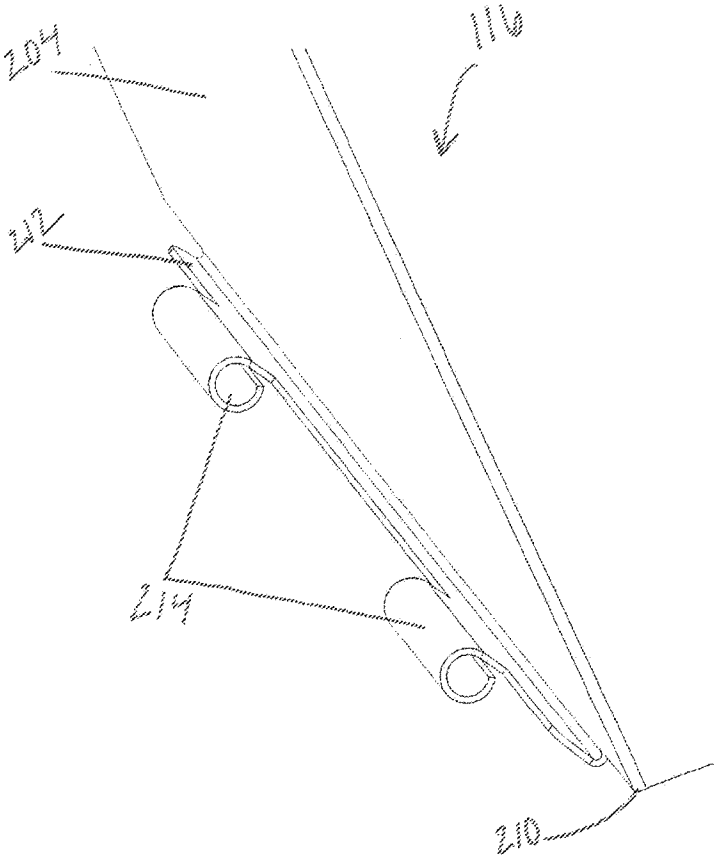
FIG. 13B is a close-up perspective view of an underside of the holding mechanism of FIGS. 12 and 13A, according to one or more embodiments.
Figure 13A:
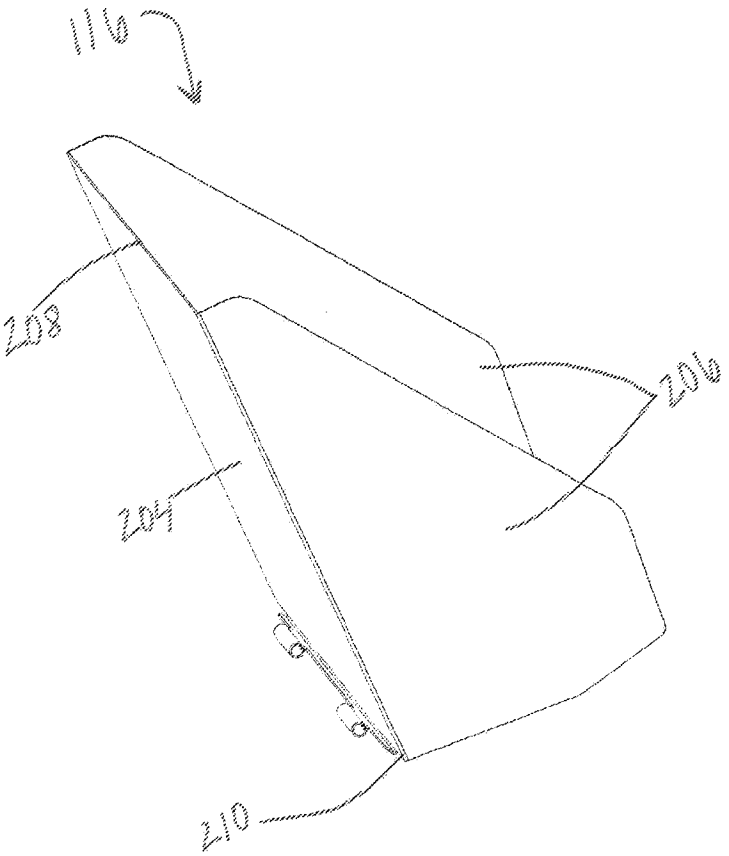
FIG. 13A is a side perspective view of the holding mechanism of FIG. 12, according to some embodiments.

Turning now to FIGS. 12, 13A and 13B, the holding or closure mechanism 116 may function together with the bin 106 to close off access to the bin 106 during compaction cycles and to hold trash or debris against a backstop 114 until the bin 106 is returned to a trash receiving position. As shown, the closure mechanism 116 may include a series of elements having surfaces that form a moveable chute. The mechanism may include a slide portion 204 and a pair of sideboards 206 configured to guide debris into the bin 106 and prevent debris from hanging up on the sidewalls or otherwise being prevented from entering the bin.

Figure 14:
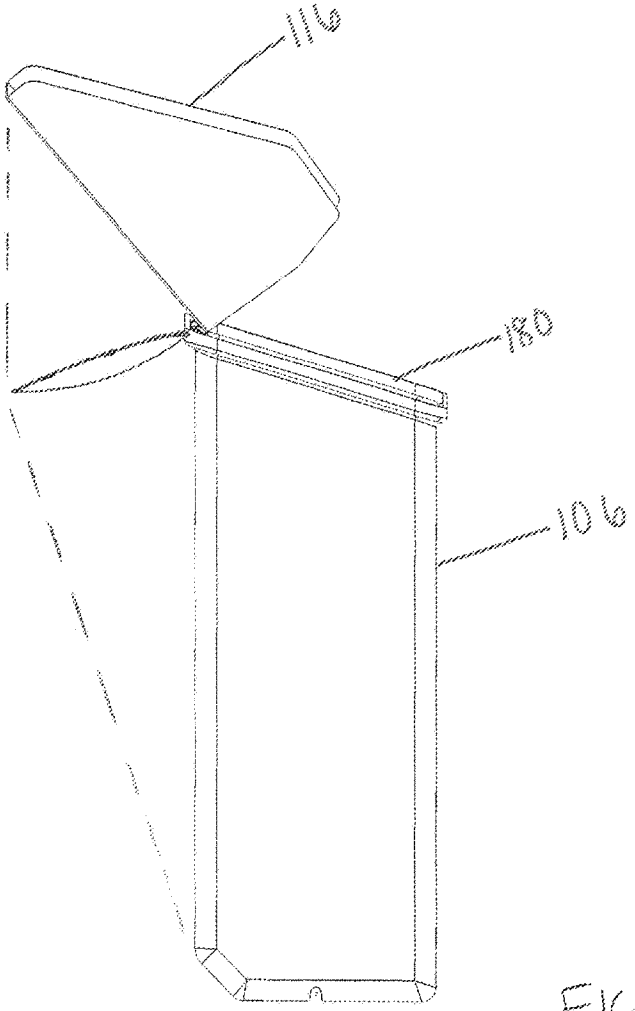
FIG. 14 is a side view of the interaction of the trash bin and the holding mechanism of the receptacle of FIG. 1, according to one or more embodiments.

As shown in FIG. 12, the slide portion 204 may include a substantially flat plate portion. The flat plate portion may have a hinged or other pivotable connection 208 to a front inside portion of the housing 110 near or at the top of the receptacle near the trash opening in the housing 110. The other end of the flat plate portion opposite the pivotable connection 208 may be a free end 210 and may rest on an inside portion of the tub or bin 106. The free end 210 may be configured to adjustably or selectively engage the top rim of the bin 106. As shown, in FIG. 13A, the free end 210 may have a doubled over or folded edge 212 extending underneath the flat plate portion. The folded edge 212 may include one or more tabs 214 extending therefrom that are curved to form cylindrical lugs or dowels, for example. As shown in FIG. 14, when the bin 106 is in an upright compaction position, the cylindrical lugs 214 may engage the groove in the flared rim 180 of the bin 106. As the bin 106 falls or is allowed to fall or is actively tipped toward the front of the receptacle 100, the cylindrical dowels may ride out of the groove toward the inside of the bin 106 due to the shortened distance between the respective pivot points of the bin 106 and the closure mechanism 116. As the bin 106 approaches a trash receiving position, the cylindrical dowels may again become seated in the groove on the inside surface of the flared rim 180 of the bin 106.

Continuing with the discussion of the holding or closure mechanism 116, the side boards 206 may include portions of the plate making up the slide portion 204, but the side boards 206 may be folded upwardly to flank the slide portion 204. The side boards 206 may be substantially trapezoidally shaped with a base edge 216 formed by the upward fold from the flat plate portion. A relatively short side edge 218 may extend upward from the flat plate portion near the hinged end thereof. A relatively long side edge 220 may extend upward from the flat plate portion near the free end 210 thereof. A sloping edge 222 may extend between the short side edge 218 and the long side edge 220. However, the peak of the trapezoidal shape formed by the sloping edge 222 and the long side edge 220 may be truncated as shown.

Figure 15:
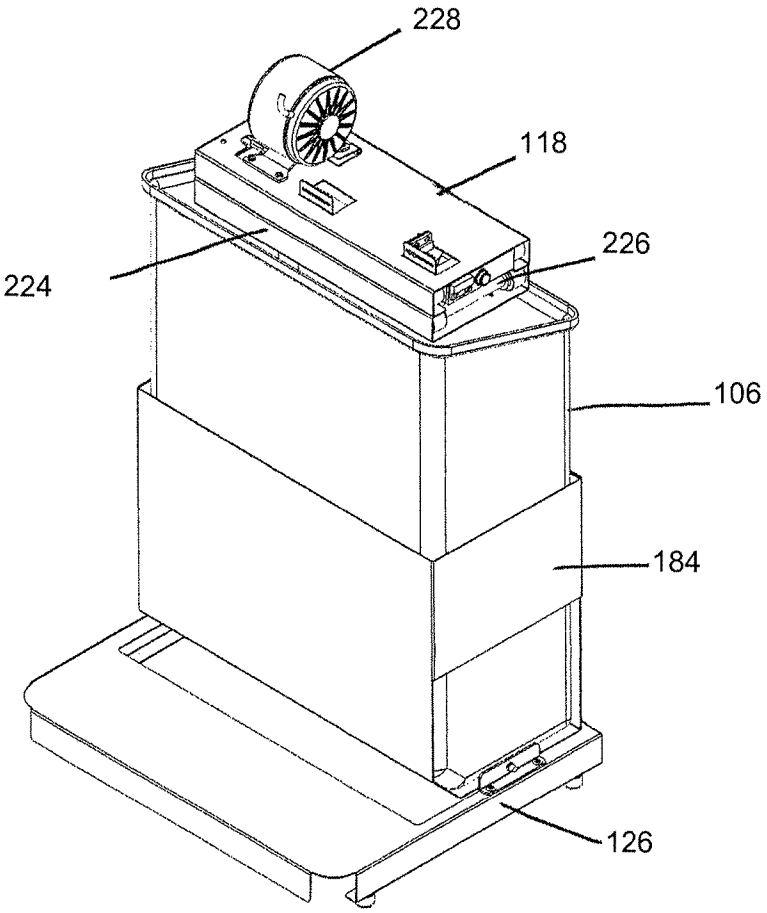
FIG. 15 is a perspective view of portions of the receptacle of FIG. 1 revealing the compaction unit, according to one or more embodiments.
Figure 16:
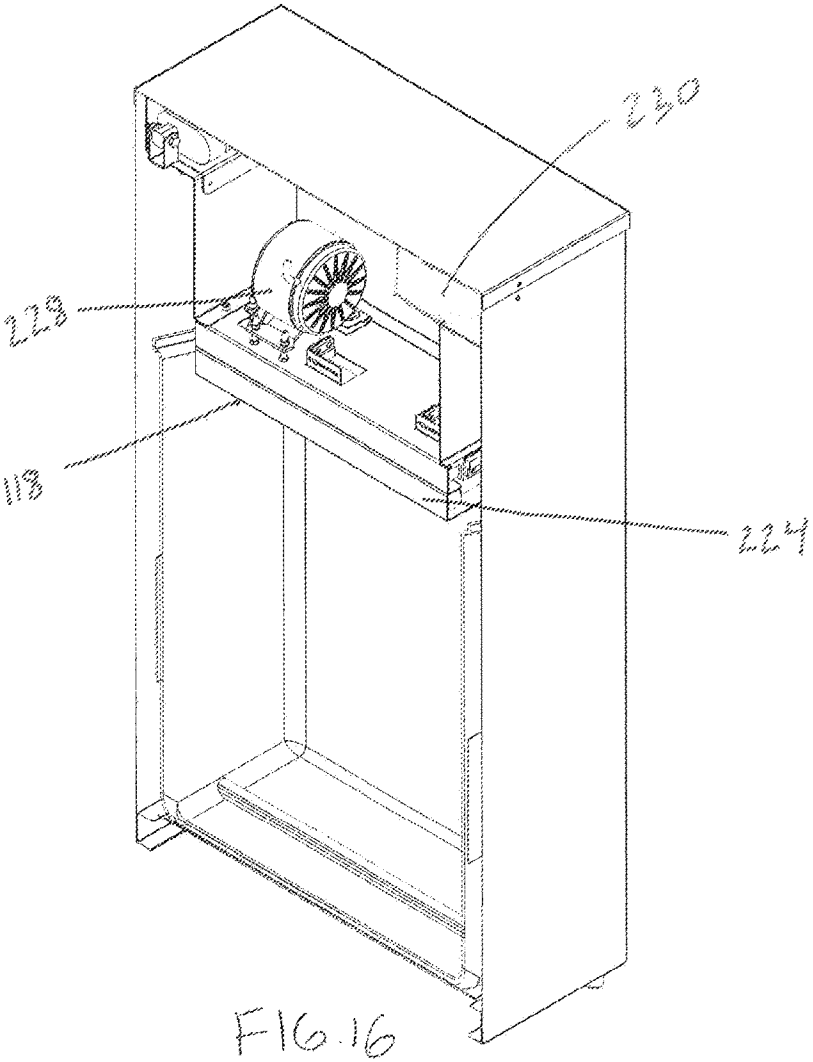
FIG. 16 is a cross-sectional perspective view of the receptacle of FIG. 1 revealing the compaction unit, according to one or more embodiments.
Figure 17:
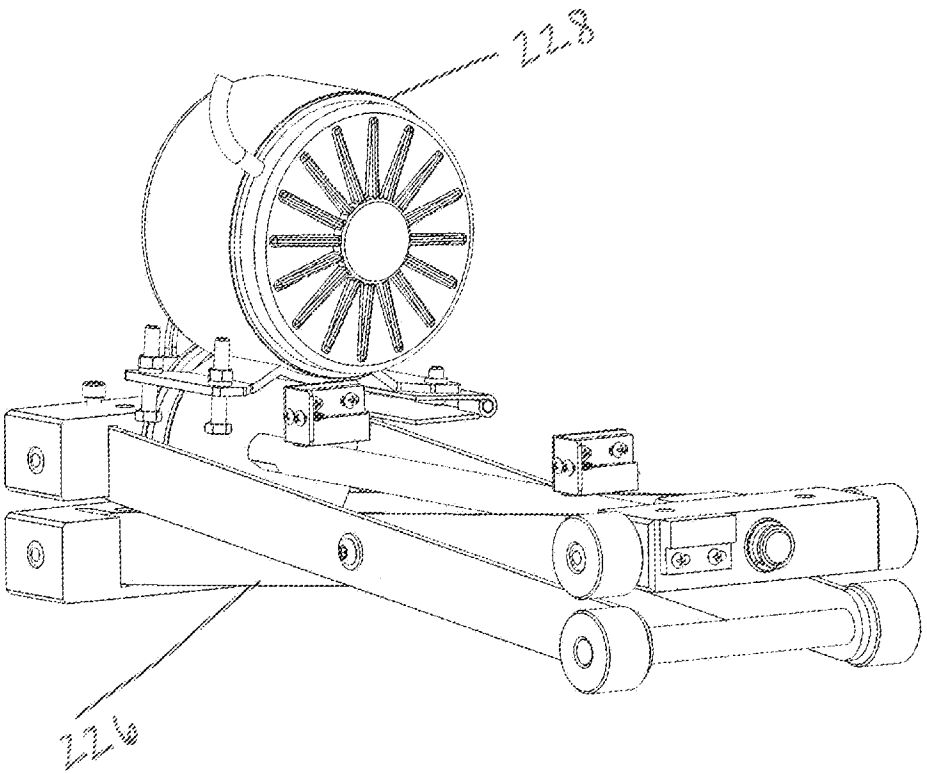
FIG. 17 is a perspective view of the linkage portion of the compaction unit of FIGS. 15 and 16.

As shown in several of the figures and, in particular, in FIGS. 15 and 16, a compaction unit 118 may be arranged in an upper rear portion of the receptacle 100. The compaction unit 118 may be configured to compress trash in the trash bin 106 when the bin 106 is in a compaction position. The compaction unit 118 may include a compaction head 224 configured for advancing to and into the bin 106 to compact trash or debris therein. The compaction head 224 may be secured to a linkage 226 for advancing the head and the linkage 226 may be operable using a motor 228. In some embodiments, the linkage used may include a scissor type linkage as shown in FIG. 17. For example, a scissor linkage may be provided on a back edge of a compaction head 224 and an additional scissor linkage may be provided on a front edge of a compaction head 224. The motor 228 may drive a screw gear or other mechanism to draw the tips of the scissor linkage together thereby causing the linkage to extend downwardly driving the compaction head 224 downwardly into the bin 106. This particular linkage may be advantageous because it provides for a relatively low power, but fast moving compaction head at the top of the compaction stroke and a relatively high power, slow moving compaction head at the bottom compaction stroke. Accordingly, a remarkable amount of speed may be recognized at the top and a remarkable amount of power may be recognized at the bottom.

While a scissor type linkage has been described, still other linkages and systems may be provided including, but not limited to, those mentioned and described in U.S. patent application Ser. No. 13/091,004 and U.S. patent application Ser. No. 12/144,235, now U.S. Pat. No. 7,950,325 each entitled Trash Compactor. In still other embodiments a straight drive compactor such as a screw-driven compaction head, a hydraulic-driven compaction head, a telescopically-driven compaction head or other straight drive-type mechanisms may be provided.

The motor 228 may be configured to drive the scissor type linkage 226 and advance the linkage 226. For example, the motor 228 may drive a translationally stationary screw gear that may draw ends of the scissor linkage 226 together causing the bottom portion or driving end of the linkage 226 to extend downward. The compaction head 224 may be configured of relatively stiff material and may be secured to a driving end of the linkage 226. The compaction head 224 may be sized and shaped to fit within the trash bin or tub 106 and to move generally freely through the bin to a bottom of the bin such that trash may be compacted against the bottom of the bin.

The compaction unit 118 may be secured to opposing sides of the receptacle 100 and may create a tensile force in the sides of the receptacle 100 when the compaction head 224 encounters trash or debris within the trash bin 106. That is, the compressive forces present in the compaction system may be resisted by the sidewalls of the compaction unit 118 in the form of tension.

The compaction unit 118 as well as the bin position control system 112 may be powered by a battery, a rechargeable battery, a solar panel, a plugin source of electricity, or a combination of such energy sources.

The receptacle 100 may also include a microcomputer or controller 230 for articulating the trash bin 106 and activating or deactivating the compaction unit 118. In some embodiments, a sensor or series of sensors may be provided for assessing the amount of trash that has been placed in the trash bin 106. At particular times or trash volumes, the controller 230 may send a signal to the bin position control system 112 to actuate the system and articulate the bin 106 rearwardly beneath the compaction unit 118 and within the housing 110. The microcomputer or controller 230 may sense when the bin 106 has been articulated into position, it may send a signal to activate the locking mechanism 150 on the base of the unit to hold the bin 106 in place and make sure a user does not reach into the unit or otherwise place things in the line of the compaction head 224 or on the linkage 226 of the compaction unit 118 when the head 224 is extended. The microcomputer or controller 230 may send a signal to the compaction unit 118 to activate the motor 228 to drive the compaction head 224 into the bin 106 and compact the trash while also retracting the head 224 once the compaction process is complete. The microcomputer or controller 230 may also release the locking mechanism 150 and cause the bin control system 112 to allow the bin 106 to articulate back to a trash receiving position within the housing 110 and positioning the mouth 104 of the trash bin 106 below the trash receiving opening. In some embodiments, the microcomputer or controller 230 may also send a signal to the bin control system 112 to allow the bin 106 to tip further into a bin removal position such that a user may access the bin through the access opening in the housing 110 and remove the bin 106 for emptying. The tipped position of the bin 106 may allow for relatively easy removal of the bin 106 from the holster 184 through the access opening.

While particular embodiments have been shown, it is to be appreciated that several alternatives may be implemented without departing from the spirit and scope of the invention. For example, in lieu of a tipping trash bin, a sliding bin may be provided. For example, the bin may slide within the housing between a front and a rear position. The rear position may define a compaction position and the front position may define a trash receiving position. In still other embodiments, multiple trash receiving bins may be provided for purposes of separating particular types of garbage or for providing a trash receiving bin when another bin is being compacted or is full. For example, a series of trash receiving bins may be arranged on a carousel or other conveyor type system that allows for selectively placing a particular bin below the compaction unit or below a trash receiving opening. In some embodiments, a selection interface may be provided allowing the user to select a particular bin by number, color, type of trash, or other selection criteria such that particular types of trash may be placed in particular types of bins. In some embodiments, this may be advantageous for recyclable material that may be sorted as it is discarded. Still other embodiments may be provided without departing from the spirit and scope of the invention.

It is to be appreciated that the presently disclosed compactor may be advantageous for several reasons. That is, the proximity of the top of the trash bin to the compaction head may be very close and a portion of the compaction head may actually be positioned within the bin when bin is in a compaction position. In other known compaction receptacles, the compaction head may be positioned above and spaced away from the bin such that incoming trash may pass below the compaction head and into the bin. This creates a larger device due to the need to maintain space between the head and the bin. This ability to maintain the close proximity of the compaction head to the bin may be provided by the ability to articular or move the trash bin out from beneath the compaction head. Moreover, as mentioned, the full containment of the system and maintaining of movement within the housing may help to prevent damage to the unit through user manipulation of the trash bin. Still other advantages are present with the presently disclosed system.

Various embodiments of the present disclosure may be described herein with reference to flowchart illustrations and/or block diagrams of methods, apparatus (systems), and computer program products. It is understood that each block of the flowchart illustrations and/or block diagrams, and/or combinations of blocks in the flowchart illustrations and/or block diagrams, can be implemented by computer-executable program code portions. These computer-executable program code portions may be provided to a processor of a general purpose computer, special purpose computer, or other programmable data processing apparatus to produce a particular machine, such that the code portions, which execute via the processor of the computer or other programmable data processing apparatus, create mechanisms for implementing the functions/acts specified in the flowchart and/or block diagram block or blocks. Alternatively, computer program implemented steps or acts may be combined with operator or human implemented steps or acts in order to carry out an embodiment of the invention.

Additionally, although a flowchart may illustrate a method as a sequential process, many of the operations in the flowcharts illustrated herein can be performed in parallel or concurrently. In addition, the order of the method steps illustrated in a flowchart may be rearranged for some embodiments. Similarly, a method illustrated in a flow chart could have additional steps not included therein or fewer steps than those shown. A method step may correspond to a method, a function, a procedure, a subroutine, a subprogram, etc.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an ingredient or element may still actually contain such item as long as there is generally no measurable effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A compaction capable receptacle, comprising:
a housing with a trash receiving opening;
a compaction unit arranged within the housing;
a trash bin arranged within the housing and articulable between a compaction position within the housing and a trash receiving position within the housing, the compaction position aligning the trash bin with a compaction stroke of the compaction unit and the trash receiving position aligning a portion of the trash bin with the trash receiving opening.

2. The receptacle of claim 1, wherein the trash bin is articulable by pivoting.

3. The receptacle of claim 2, further comprising a locking mechanism configured to lock the trash bin in position during compaction.

4. The receptacle of claim 1, further comprising a flap for engaging the trash bin in the compaction position and closing off access to the compaction unit and the trash bin.

5. The receptacle of claim 4, wherein the flap is part of a backstop portion of the trash receiving opening.

6. The receptacle of claim 4, wherein a top rim of the trash bin is sloped to engage the flap in a compaction position, but clear the flap as the trash bin transitions to a trash receiving position.

7. The receptacle of claim 6, wherein the trash bin is arranged substantially vertically in the compaction position and is arranged at an angle to horizontal in the trash receiving position.

8. The receptacle of claim 7, wherein the slope of the top rim relative to a plane of the front or back wall of the bin is equal to the angle of the trash bin in the trash receiving position such that the rim is arranged substantially horizontally in the trash receiving position.

9. The receptacle of claim 8, wherein the top rim of the bin forms a mouth and the mouth is arranged in substantial alignment with the trash receiving opening in the trash receiving position.

10. The receptacle of claim 1, further comprising a holding portion arranged between the trash receiving opening and the trash bin and configured to hold trash when the trash bin is in a compaction position and feed the held trash to the trash bin as the trash bin returns to the trash receiving position.

11. The receptacle of claim 10, wherein the holding portion is configured to adjustably or selectively engage the top rim of the bin.

12. The receptacle of claim 11, wherein the trash bin comprises a flared rim with a groove and the holding portion comprises a lug for engaging the groove.

13. The receptacle of claim 12, wherein the lug engages the groove in the compaction position and the trash receiving position, but releases from engagement with the groove as the trash bin articulates between these positions.

14. The receptacle of claim 1, wherein the compaction unit comprises a scissor mechanism.

15. The receptacle of claim 1, further comprising a bin position control.

16. The receptacle of claim 15, wherein the bin position control comprises an actuation mechanism configured to articulate the trash bin.

17. The receptacle of claim 16, wherein the bin position control comprises a holster configured to nestingly receive the trash bin and control the position of the trash bin.

18. The receptacle of claim 17, wherein the bin position control comprises a strut or tie for controlling the position of the holster.

19. The receptacle of claim 18, further comprising a controller for coordinating the position of the trash bin and the timing of compaction cycles.

20. The receptacle of claim 19, wherein the controller activates and deactivates a locking mechanism for securing the holster in position for compaction.

* * * * *